United States Patent [19]

Pichette

[11] 4,339,898

[45] Jul. 20, 1982

[54] COMBINATION FASCIA AND J-TRIM

[76] Inventor: Carold Pichette, 163, rue de l'Eglise, Château-Richer, Prov. of Quebec, Canada, GOA 1NO

[21] Appl. No.: 187,950

[22] Filed: Sep. 16, 1980

[51] Int. Cl.[3] ..... E04B 7/00

[52] U.S. Cl. ..... 52/94; 52/278; 52/716

[58] Field of Search ..... 52/94–96, 52/11, 716–718, 275–278, 478, 553

[56] References Cited

U.S. PATENT DOCUMENTS

| | | | |
|---|---|---|---|
| 801,154 | 10/1905 | Pioch | 52/278 |
| 908,858 | 1/1909 | Goddard | 52/718 |
| 1,108,446 | 8/1914 | Johnson | 52/718 |
| 3,455,080 | 7/1969 | Meadows | 52/716 |
| 3,612,453 | 10/1971 | Zimmer | 52/11 |
| 3,735,540 | 5/1973 | Thaler | 52/96 |
| 4,226,059 | 10/1980 | Pichette | 52/94 |

*Primary Examiner*—James L. Ridgill, Jr.

[57] ABSTRACT

A combination fascia and G-trim moulding is disclosed comprising, firstly, a J-trim moulding in two pieces each having a generally L-shaped profile singly and a U-shaped profile when secured together; and, secondly, a fascia moulding having a vertical portion and a horizontal portion, the latter having a downwardly extending flange at its free edge; the flange engaging a longitudinally extending deep slot formed in the attaching branch of the upper piece of the J-trim.

2 Claims, 2 Drawing Figures

COMBINATION FASCIA AND J-TRIM

FIELD OF THE INVENTION

The present invention relates to building construction mouldings, more specifically to mouldings designed to be support means for soffits and fascias at the eaves of a building.

BACKGROUND OF THE INVENTION

The installation of soffits and fascia moulding has been till now difficult and time-consuming because, in the case of soffits, conventional J-trim mouldings are made in one piece and must be permanently fixed to the eaves of a building by means of nails or other known means at each end of the soffits to be installed. The soffit panels then have to be cornered and pushed into place. Such a procedure is not always easy. In the case of fascia mouldings, there are undesirable nails or screws (which may rust) to contend with. Moreover, the installation of soffits and fascia mouldings is often done at the second or even third storey of a building, a fact which makes such installation doubly difficult and expensive.

OBJECTS OF THE INVENTION

Accordingly, it is a first object of the present invention to provide combination fascia and J-trim mouldings wherein both mouldings are securely fitted together easily and quickly thus eliminating the above mentioned disadvantages.

It is another object of the present invention to provide combination fascia and J-trim mouldings which have aesthetic and invisible attaching means.

SUMMARY OF THE INVENTION

The above and other objects and advantages of the present invention are realized in accordance with a preferred embodiment comprising, firstly, a J-trim moulding in two pieces, the pieces adapted to be fitted together by simple pressure of one piece toward the other such that a secure locking fit is obtained. Secondly, a fascia moulding is provided, with attaching means to secure the same to one of the pieces of the J-trim and also to the wall of the building receiving the mouldings.

The two pieces of the J-trim as well as the fascia moulding are substantially L-shaped in profile. The two pieces of J-trim are provided with joining means which mutually engage each other and overlap each other in final locked position.

The above will be more clearly understood by having referral to the preferred embodiment of the invention, illustrated by way of the accompanying drawings, in which:

BRIEF DESCRIPTION OF THE DRAWINGS

Like numerals refer to like elements throughout the drawings.

DETAILED DESCRIPTION OF THE INVENTION

Figure 1:
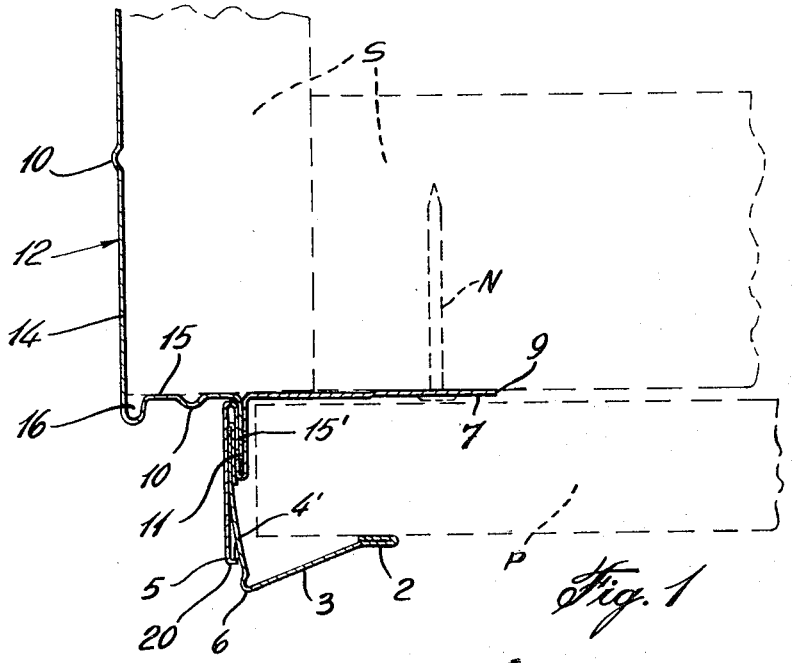
FIG. 1 is a cross-sectional side elevation of the J-trim and fascia mouldings installed on the wall of a building, also showing in dashed outline the structure of the wall, and an installed soffit panel.
Figure 2:
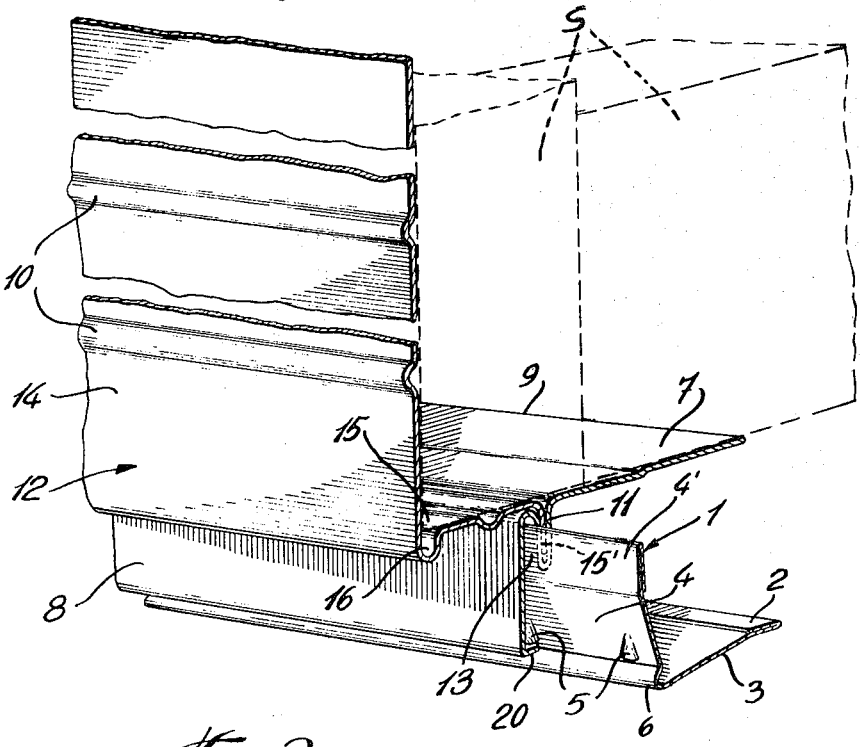
FIG. 2 is a perspective view of the J-trim and fascia mouldings showing how the two pieces of the J-trim fit together.

Referring first to the J-trim, the latter comprises a covering piece 1 made of an elastic material, preferably plastic or sheet metal, and having a generally L-shaped profile. Piece 1 has a covering branch 3 which is upwardly and inwardly inclined and terminates in a lip 2 generally horizontal and formed by being bent back upon itself. Lip 2 is provided for extra strength and for a nicer finish.

Piece 1 also has a joining branch 4 which is upwardly outwardly inclined for a portion of about half of its length and becomes vertical at its top portion 4'. This portion 4' is bent back upon itself to be of double thickness. The lower outer surface of joining branch 4 is provided with a plurality of longitudinally spaced-apart teeth 5 formed by indentation of the material of which joining branch 4 is made. Teeth 5 are all evenly located above the junction 6 of joining branch 4 and covering branch 3. Junction 6 is slightly outwardly curved. Teeth 5 flare downwardly and outwardly relative to the surface of joining branch 4.

The second piece of the J-trim is also made of flexible or elastic material and comprises an attaching branch 7 and a joining branch 8. The two branches 7 and 8 each define a generally L-shaped profile.

Attaching branch 7 is long and generally horizontal and is provided with holes near its inner edge 9 through which nails N may be driven to secure the same to the structural elements 5 of a building. At least one reinforcement shallow groove 10 is provided on attaching branch 7 for added strength. The latter is also formed with a deep slot 11 to secure the fascia moulding 12, as will be explained below. Slot 11 extends longitudinally and is formed by bending the material of attaching branch 7 downwardly and then upwardly.

Immediately outwardly of slot 11, joining branch 8 extends downwardly defining an upper space 13. The lower edge of joining branch 8 extends inwardly a short distance forming a longitudinal step 20.

Fascia moulding 12 comprises a vertical wall portion 14, provided with longitudinal reinforcement grooves 10 and a horizontal inwardly-extending portion 15, also provided with a reinforcement groove 10. The free edge of the horizontal portion 15 is bent downwardly at a right angle to form a flange 15'.

The manner of installation of the combination fascia moulding and J-trim will be readily appreciated. Firstly, fascia moulding 12 is installed and its top edge secured; then the attaching branch 7 is rigidly secured to the eaves structure S by nails after causing deep slot 11 to receive flange 15' of fascia 12. Next a soffit panel P is placed in position, as indicated in FIG. 1. Finally, the top portion 4' of joining branch 4 is slid upwardly into space 13, thus causing the teeth 5 to engage and overlap step 20 of joining branch 8, providing a secure and locking fit.

The junction of the two portions 14 and 15 of fascia moulding 12 is provided with a downwardly-extending channel 16 to prevent water from seeping along the lower surface of horizontal portion 15 toward the J-trim mouldings, thereby eliminating rust or discoloration of the mouldings.

What I claim is:

1. A combination fascia and J-trim moulding comprising, firstly, a J-trim moulding in two pieces, a first piece and a second piece, each piece having a generally L-shaped profile and being made of a flexible material; each piece comprising a first branch and a second branch; the second branches being attachable one to the other by overlapping attaching means; the first branches projecting in the same direction relative to the second branches such that the said two pieces when attached define a U-shaped profile; the first branch of the first piece being provided with a longitudinally extending deep slot; the said second branch of the said first piece and said deep slot defining a longitudinally extending space; the top portion of the said second branch of the said second piece being adapted to be slid into said longitudinally extending space up to a limit locking position; comprising, secondly, a fascia moulding having a vertical portion and a horizontal portion wherein the free edge of said horizontal portion is provided with a downwardly extending flange; said flange being adapted to slide in said deep slot up to a final secured position; said second branches of said two pieces serving as joining branches, and said first branch of said first piece serving as an attaching branch and said first branch of said second piece serving as a covering branch.

2. A combination fascia and J-trim moulding as defined in claim 1 wherein said attaching means consists of an inwardly directed step formed at the lower edge of the said second branch of said first piece and a plurality of longitudinally spaced-apart teeth formed on the lower outer surface of said second branch of said second piece; wherein said teeth are adapted to overlap said step to provide a secure locking fit.

* * * * *